United States Patent [19]

Grifhorst

[11] 4,343,470

[45] Aug. 10, 1982

[54] BALL ROLLING GAME

[76] Inventor: Norman J. Grifhorst, 131 N. Hillside, Wichita, Kans. 67208

[21] Appl. No.: 233,008

[22] Filed: Feb. 9, 1981

[51] Int. Cl.[3] ..... A63F 7/00

[52] U.S. Cl. ..... 273/123 R; 273/176 F; 273/352

[58] Field of Search ..... 273/1 GA, 1 GB, 34 R, 273/123 R, 124 R, 125 R, 127 R, 127 B, 127 C, 176 B, 176 F, 177 R, 177 A, 177 B, 178 R, 178 A, 178 B, 179 R, 179 A, 179 B, 179 C, 179 D, 179 E, 180, 181 A, 181 D, 184 A, 185 R, 340, 352, 398; D21/3, 5, 8, 9, 10

[56] References Cited

U.S. PATENT DOCUMENTS

| | | | |
|---|---|---|---|
| 1,156,438 | 10/1915 | Simpson | 273/125 R |
| 1,313,783 | 8/1919 | Blackburn | 273/352 |
| 1,979,584 | 11/1934 | Thompson | 273/180 |
| 3,342,495 | 9/1967 | Wasley | 273/176 F |
| 4,124,210 | 11/1978 | Mason | 273/177 R X |

*Primary Examiner*—Richard T. Stouffer
*Attorney, Agent, or Firm*—Edwin H. Crabtree

[57] ABSTRACT

A new ball rolling game for the enjoyment of one or more players. The game having an inclined ramp mounted on top of a plurality of semi-circular dividers. By accurately rolling a ball as high as possible up the inclined ramp, the ball will fall beside one of the dividers having a higher score than a divider at the lower end of the ramp.

4 Claims, 3 Drawing Figures

BALL ROLLING GAME

BACKGROUND OF THE INVENTION

This invention relates to a ball game and more particularly, but not by way of limitation, to a ball rolling game for one or more players wherein the ball is rolled upwardly on an inclined ramp and when the ball rolls off the ramp, the ball is received between semi-circular dividers having a number indicating the score for receipt between those particular dividers.

Heretofore, there have been various types of ball rolling games, such as pinball machines and more particularly games such as the game apparatus described in the subject inventor's U.S. Pat. No. 4,190,250. Also, there are various types of games described in U.S. Pat. No. 443,889 to Armstrong, U.S. Pat. No. 1,195,173 to Beamer, et al, U.S. Pat. No. 1,269,323 to Shattuck, U.S. Pat. No. 1,395,634 to Fegteborg, U.S. Pat. No. 1,474,089 to Roberts, U.S. Pat. No. 1,890,770 to Coplen, et al, U.S. Pat. No. 1,921,186 to Henderson, and U.S. Pat. No. 3,424,463 to Mathews. None of the above mentioned patents describe the unique features of the subject invention as described herein.

SUMMARY OF THE INVENTION

The subject invention is lightweight, inexpensive, and can be easily disassembled for packaging and quickly assembled for the playing of the game.

Further, the ball rolling game can be made of various types of flat flexible material such as a plastic sheet material, or the like, and can be played with different types and sizes of round balls.

The game is easy to understand and the player's skill can quickly be improved by the practicing of accurately rolling the ball upwardly along an inclined ramp having a launch pad and tapered neck. The further the ball rolls up the ramp before falling off the ramp, the higher the score obtained by the player. If the ball is accurately thrown, it will roll upwardly and off the end of the ramp into a divider having the highest score. By keeping track of the number of balls thrown and the scores received when the ball is received between the dividers, the highest score determines the winner of the ball rolling game. The game can be played by one or more players.

The invention includes at least one ball with a plurality of dividers having side portions and a center portion. The dividers can be made of a flat sheet plastic, or the like, and they are disposed in a vertical position and formed into a semi-circular shape with the ends of the side portions attached to the side portions of an adjacent divider. The center portion of each divider is disposed in a spaced relationship to the center portion of an adjacent divider for receiving the ball therebetween. An elongated ramp having a wedge-shaped launch pad and an elongated tapered neck is received between one of the semi-circular dividers with the neck of the ramp received on a portion of the top of the center portion of the dividers and centered thereon.

The advantages and objects of the invention sill become evident from the following detailed description of the drawings when read in connection with the accompanying drawings which illustrate preferred embodiments of the invention.

DETAILED DESCRIPTION OF THE DRAWINGS

Figure 1:
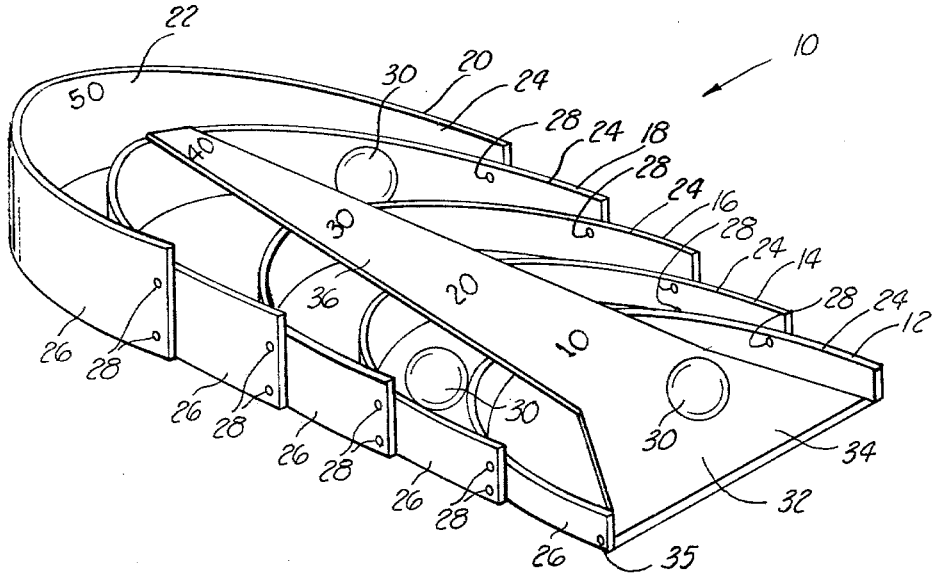
FIG. 1 illustrates a perspective view of the ball rolling game.

In FIG. 1 a perspective view of the ball rolling game is illustrated and designated by general reference numeral 10. The game 10 includes a first semi-circular divider 12, a second semi-circular divider 14, a third semi-circular divider 16, a fourth semi-circular divider 18, and a fifth semi-circular divider 20. Each of the dividers includes a center portion 22 along with side portions 24 and 26. The dividers are made of a lightweight sheet plastic or any similar material that can be readily formed into the semi-circular shape. The dividers when assembling the game 10, are formed into a semi-circular shape with the side portions 24 and 26 attached to the side portions 24 and 26 of an adjacent divider by metal clips 28, or any other attachment means such as a tongue received in a groove, adhesive tape and the like.

When the dividers are formed into a semi-circular shape and attached to each other, the center portions 22 of each divider are disposed in a spaced relationship from the adjacent divider so that a ball 30 can be received therebetween. FIG. 1 shows two balls 30 received between adjacent dividers with an additional ball 30 disposed on top of a ramp 32.

The ramp 32 includes a wedge-shaped launch pad 34 which extends across the width of the first divider 12, with the ends of the launch pad 32 secured to the ends of the side portion 26 of the first divider 12 by a clip 35. Integrally attached to the launch pad 34 and forming part of the ramp 32 is an elongated neck 36 which is tapered inwardly and extends upwardly on top of a portion of each center portion 22 of the dividers 12, 14, 16 and 18.

It should be noted in FIG. 1 that the ramp indicates scores of 10, 20, 30 and 40 thereon to designate the score when the ball falls off the side of the neck 36 and is received between the adjacent dividers in that particular score area. If the ball 30 is accurately rolled upwardly along the tapered neck 36, and off the end of the neck 36, the ball 30 will be received between the fourth divider 18 and fifth divider 20 for a score of 50.

It can be appreciated that while there are five dividers shown in FIG. 1, there can be various numbers of dividers so that different numbers of scores may be designated without departing from the spirit and scope of the invention.

Figure 2:
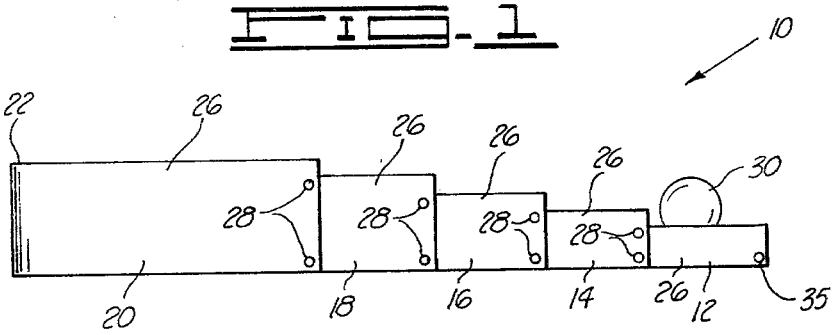
FIG. 2 illustrates a side view of the ball rolling game.

In FIG. 2 a side view of the game 10 is shown with a portion of the ball 30 shown on top of the launch pad 34 of the ramp 32 which is hidden behind the side portion 26 of the first divider 12. Also in FIG. 2 the stair-step height of each divider 12, 14, 16, 18 and 20 is illustrated so that the ramp 32 when it is received on top of a portion of the center portion 22 of each divider, the ramp 32 is inclined upwardly and therefore causes the ball 30 to slow its acceleration and deceleration as it moves upwardly along the length of the elongated neck 36 of the ramp 32.

Figure 3:
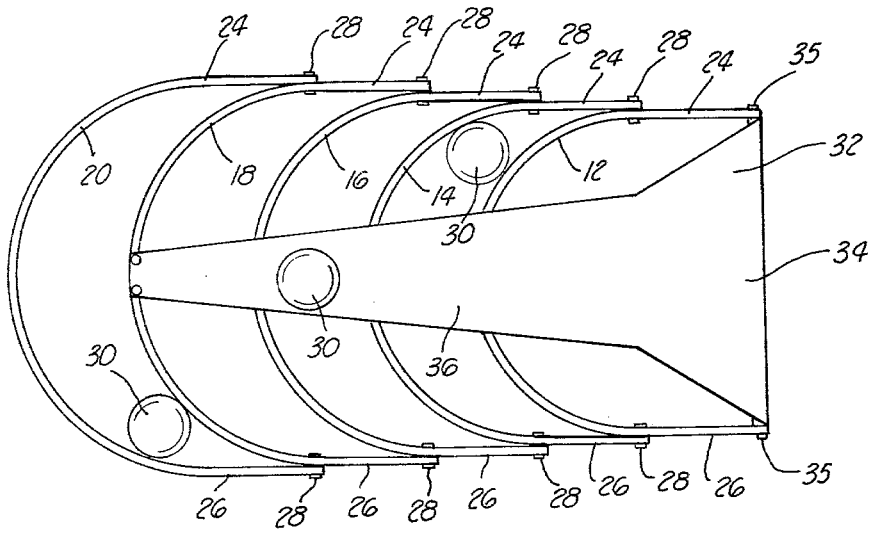
FIG. 3 illustrates a top view of the ball rolling game.

In FIG. 3 a top view of the ball rolling game 10 is illustrated with one of the balls 30 received between the first and second dividers 12 and 14, and a ball 30 received between the fourth and fifth dividers 18 and 20. Also, a ball 30 is shown moving upwardly toward the end of the elongated neck 36 of the ramp 32.

It can be appreciated from reviewing the ball rolling game 10 in FIGS. 1 through 3, that the ball rolling game can be quickly learned and with practice, a skill can be developed in accurately rolling the balls 30 upwardly on the launch ramp 32, onto the elongated neck 36, and off the end of the neck 36 to obtain as high a score as possible. By adding the combined scores, designated by the area where the ball is received between the dividers, the player with the highest score wins the game and the balls 30 are again collected and the game repeated to the enjoyment of the players.

Changes may be made in the construction and arrangement of the parts or elements of the embodiments as disclosed herein without departing from the spirit or scope of the invention as defined in the following claims.

I claim:

1. A ball rolling game for the enjoyment of one or more players, the game comprising:

a ball;

a plurality of dividers, each of the dividers having side portions and a center portion, the dividers disposed in a vertical position and formed into a semi-circular shape with the ends of the side portions abutting against and attached to the side portions of each of the adjacent dividers, the center portion of each of the dividers disposed in a spaced relationship to the center portion of the adjacent one of the dividers a sufficient distance to receive the ball therebetween; and an elongated ramp, the ramp having a wedge-shaped launch pad and an elongated neck integrally attached to the launch pad, the launch pad extending the width of the forward most semi-circular divider and attached thereto, the neck of the ramp received on a portion of the top of the center portion of all but the rearwardmost the dividers and centered thereon;

the ball adapted to be rolled onto the launch pad of the ramp and upwardly along the neck of the ramp until the ball falls off the side or the end of the ramp where it is to be received between the center portions of two adjacent ones of the dividers.

2. The game as described in claim 1 wherein the height of each of the dividers is increased in a stair-step fashion upwardly from the forward most divider receiving the launch pad of the ramp to the divider receiving the end of the neck of the ramp so that the ramp is tilted upwardly from the launch pad to the end of the neck.

3. The game as described in claim 1 wherein the neck of the ramp is tapered inwardly from the launch pad to the end of the neck.

4. A ball rolling game for the enjoyment of one or more players, the game comprising:

a ball;

a plurality of dividers having side portions and a center portion, the dividers disposed in a vertical position and formed into a semi-circular shape with the ends of the side portions abutting against and attached to the side portion of each of the adjacent dividers, the center portion of each of the dividers disposed in a spaced relationship to the center portion of the adjacent one of the dividers a sufficient distance to receive the ball therebetween; and an elongated ramp, the ramp having a wedge-shaped launch pad and an elongated neck integrally attached to the launch pad and tapered inwardly from the launch pad to the end of the neck, the launch pad extending across the width of one of the forward most semi-circular dividers and attached thereto, the neck of the ramp received on a portion of the top of the center portion of all but the rearwardmost of the dividers and centered thereon, the height of each divider increased in a stair-step fashion upwardly from the forward most divider receiving the launch pad of the ramp to the divider receiving the end of the neck of the ramp so that the ramp is tilted upwardly from the launch pad to the end of the neck; and the ball adapted to be rolled onto the launch pad of the ramp and upwardly along the neck of the ramp until the ball falls off the side or the end of the ramp where it is to be received between the center portions of two adjacent ones of the dividers.

* * * * *